US010367593B2

(12) United States Patent
Arrington

(10) Patent No.: US 10,367,593 B2
(45) Date of Patent: Jul. 30, 2019

(54) ARCHITECTURE FOR A WIRELESS MEDIA SYSTEM

(71) Applicant: Arria Live Media, Inc., Hillsboro, OR (US)

(72) Inventor: Edward D. Arrington, Hillsboro, OR (US)

(73) Assignee: Arria Live Media, Inc., Hillsboro, OR (US)

( * ) Notice: Subject to any disclaimer, the term of this patent is extended or adjusted under 35 U.S.C. 154(b) by 0 days.

(21) Appl. No.: 16/057,517

(22) Filed: Aug. 7, 2018

(65) Prior Publication Data

US 2019/0081715 A1 Mar. 14, 2019

Related U.S. Application Data

(60) Provisional application No. 62/557,540, filed on Sep. 12, 2017.

(51) Int. Cl.

| | |
|---|---|
| ***H04H 40/00*** | (2009.01) |
| ***H04H 20/71*** | (2008.01) |
| ***H04H 60/04*** | (2008.01) |
| ***H04H 20/42*** | (2008.01) |

(52) U.S. Cl.
CPC ..... *H04H 20/71* (2013.01); *H04H 20/423* (2013.01); *H04H 60/04* (2013.01)

(58) Field of Classification Search
CPC ..... H04R 3/12; H04R 2420/07; H04R 3/005; H04R 5/04; H04R 1/406; H04R 29/008; H04R 3/00; H04R 2227/003; H04R 23/02; H04R 2410/00; H04R 2420/01; H04R 2420/09; H04R 2430/01; G06F 3/165; G06F 3/16
USPC ..... 455/3.06
See application file for complete search history.

(56) References Cited

U.S. PATENT DOCUMENTS

| | | | | |
|---|---|---|---|---|
| 6,611,537 | B1 | 8/2003 | Edens et al. | |
| 7,027,775 | B2 | 4/2006 | Kamimura | |
| 8,744,087 | B2 | 6/2014 | Bodley et al. | |
| 9,031,262 | B2 | 5/2015 | Silfvast et al. | |
| 9,071,913 | B2 | 6/2015 | Koch et al. | |
| 9,514,723 | B2 | 12/2016 | Silfvast et al. | |
| 9,615,175 | B2 | 4/2017 | Georgi et al. | |
| 9,621,224 | B2 | 4/2017 | Babarskas et al. | |
| 2002/0042282 | A1 | 4/2002 | Haupt | |
| 2003/0023741 | A1 | 1/2003 | Tomassetti et al. | |
| 2007/0117580 | A1 | 5/2007 | Fehr | |
| 2007/0149246 | A1 | 6/2007 | Bodley et al. | |
| 2009/0233617 | A1 | 9/2009 | Bjamason et al. | |
| 2012/0258751 | A1 | 10/2012 | Koch et al. | |
| 2012/0281848 | A1 | 11/2012 | Koch et al. | |
| 2013/0090054 | A1* | 4/2013 | Bair | H04W 40/00 455/3.05 |

* cited by examiner

*Primary Examiner* — Tu X Nguyen
(74) *Attorney, Agent, or Firm* — Chernoff, Vilhauer, McClung & Stenzel, LLP

(57) ABSTRACT

A media system that includes one or more wireless portions.

30 Claims, 18 Drawing Sheets

Figure 1 – Typical Multi-Channel Wireless Microphone Arrangement

Figure 2 – ArriaLive Multi-Channel Wireless Microphone Arrangement

FREQUENCY ALLOCATION

POWER ON TRANSMITTER PORTION(S)

ALLOCATE FREQUENCIES TO TRANSMITTER PORTION(S)

RECEIVER PORTION(S) AND TRANSMITTER PORTION(S) USE ALLOCATED FREQUENCIES

UPDATE FREQUENCY ALLOCADTION

RECEIVER PORTION(S) AND TRANSMITTER PORTION(S) USE UPDATED ALLOCATED FREQUENCIES

FIG. 18

POWER LEVELS

SENSE RECEIVED SIGNAL STRENGTH AT MULTIPLE RECEIVER PORTIONS

DETERMINE UHF POWER LEVELS BASED UPON SENSED RECEIVED SIGNAL STRENGTH

SET POWER LEVELS BASED UPON DETERMINED UHF POWER LEVELS

FIG. 19

PAIRING COMPONENTS

PAIR TRANSMITTER PORTION TO RECEIVER PORTION BASED UPON SIGNAL STRENGTH

TUNE RECEIVER PORTION(S) USING NETWORK

TUNE TRANSMITTER PORTION(S) USING DATA LINK

SET TRANSMITTER PORTION(S) POWER LEVEL USING DATA LINK

AUDIO SIGNAL ROUTING INCLUDES TRANSMITTER PORTION IDENTIFIER

FIG. 20

UPDATES TO FREQUENCY, TRANSMISSION POWER, AND PAIRING

SYSTEM UPDATES FREQUENCY, TRANSMISSION, AND/OR PAIRING

PHYSICAL AUDIO SIGNAL ROUTING REMAINS UNCHANGED

FIG. 21

STATUS INFORMATION

STATUS INFORMATION AVAILABLE ON NETWORK CONNECTED COMPUTING DEVICES

FIG. 22

ARCHITECTURE FOR A WIRELESS MEDIA SYSTEM

CROSS-REFERENCE TO RELATED APPLICATIONS

This application claims the benefit of U.S. Provisional Patent Application Ser. No. 62/557,540 filed Sep. 12, 2017 entitled Architecture For A Wireless Media System.

FIELD OF THE INVENTION

The present invention relates to a media system.

BACKGROUND OF THE INVENTION

Media systems receive audio and/or video media streams from one or more sources, process the media streams in some manner, and then distribute the one or more resulting media streams to one or more output devices which may include speakers, video monitors, and recording devices.

A mixing console or audio mixer, generally referred to as a sound board is an electronic device for combining audio signals, routing the received and/or combined audio signals, and changing the level, timbre, and/or dynamics of the audio signals. The modified signals are combined together to produce combined output signals.

Multiple mixers may be used where the mixers perform sub-mixing. The mixing of the audio signals occurs in a hierarchical fashion, with groups of signals being pre-mixed in one mixer, and the result of that pre-mix being fed into another mixer where it is combined with other individual signals or other pre-mixes coming from other sub-mixers.

Referring to FIG. 1, traditionally media systems are implemented using a central mixing console that is responsible for combining, processing, and distributing the various media streams. The system's connectivity is configured with the central device as a hub and point-to-point connections extending between the central device and each input or output device. Furthermore, in most instances, these point-to-point connections between the central device and endpoints usually accommodate only the media signal itself. The central device does not typically have a manner of determining what endpoint devices are connected to it, nor a manner of directly controlling the endpoint devices.

For example, in the case of a sound reinforcement system for live performance, the central device is the audio mixing console. The endpoint devices are microphones, instruments, and speakers, and the connectivity between each of these endpoints and the mixing console is an analog cable.

The mixing console cannot determine by itself which of its ports have endpoint devices connected, nor can it determine what endpoint device is connected to a given port, nor can it directly control endpoint devices. As a result, signal routing is often very complex and it is very common for errors to occur when setting up the many signal paths required in a typical sound system.

Because the mixing console cannot determine how many of its ports have endpoint devices connected, it must always present the user with control capabilities for all possible ports. So even if there is only one microphone and one speaker connected, the user must still cope with a complicated control interface that may support dozens of endpoint devices. Also, the inability to control endpoints often makes it necessary for a system operator to physically go to where the endpoint devices are located in order to adjust endpoint device settings such as power on/off, gain, frequency, etc.

Referring to FIG. 2, in the case of a consumer entertainment system, the central device is an A/V receiver, and the endpoints are devices such as cable boxes, DVRs, media streamers, speakers, and video monitors. Connectivity between the endpoints and the central device is usually implemented either with one or more analog cables, optical cables, or via digital HDMI cables, all of which are strictly point-to-point connections.

While HDMI cables may provide for exchange of some limited device identification and control information, analog and optical cables do not. So, in the general case, the A/V receiver does not necessarily know which of its ports have devices connected, what the connected devices are, or have a way to control those devices. This gives rise to the alarmingly large collection of remote control units needed to operate a typical consumer entertainment system, which in turn makes such systems so very difficult to fathom and vexing to use.

BRIEF DESCRIPTION OF THE DRAWINGS

FIG. 18 illustrates frequency allocation.

FIG. 19 illustrates power levels.

FIG. 20 illustrates pairing components.

FIG. 21 illustrates updates to frequency, transmission, and pairing.

FIG. 22 illustrates status information.

DETAILED DESCRIPTION OF PREFERRED EMBODIMENTS

Figure 1:
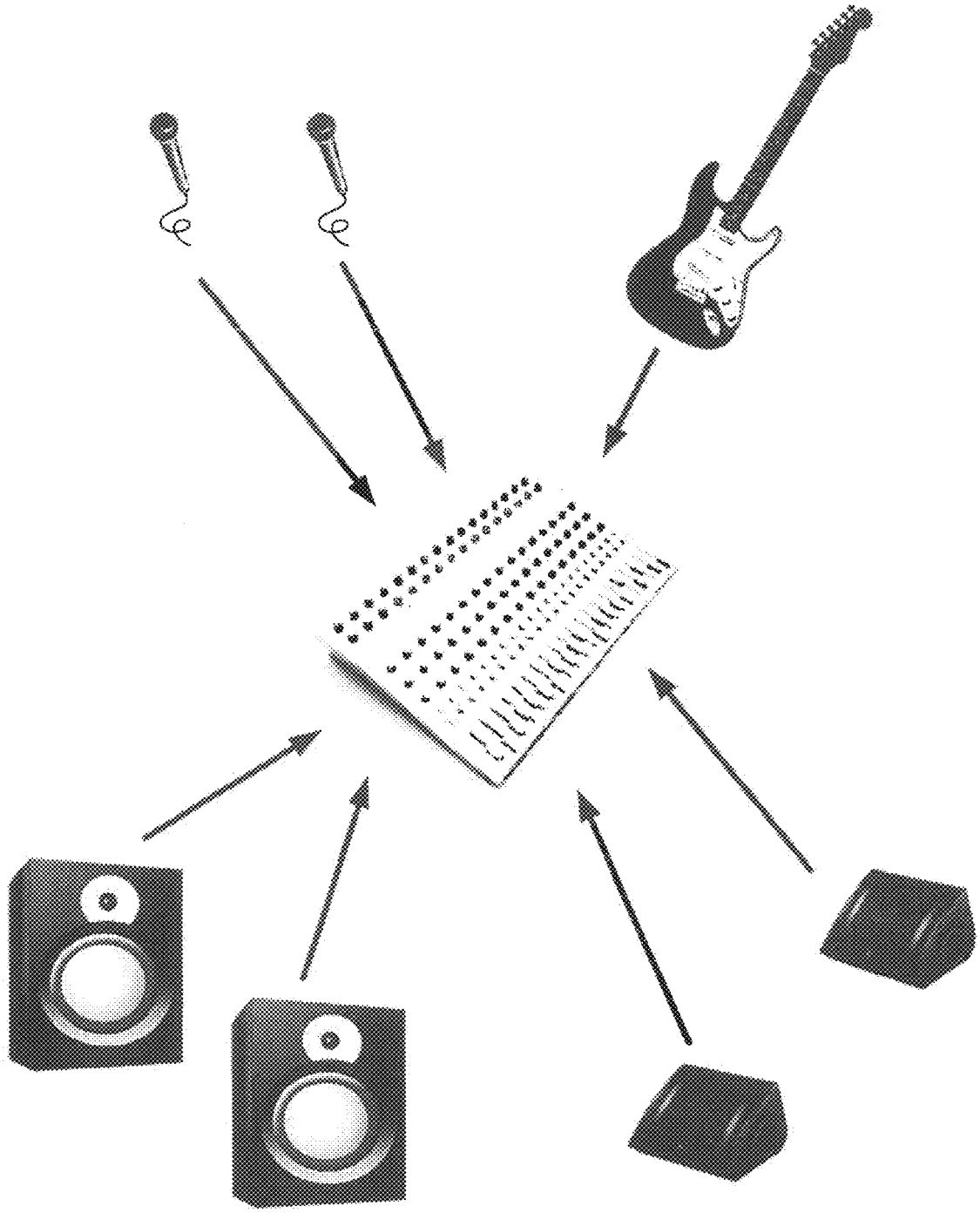
FIG. 1 illustrates a media system.
Figure 2:
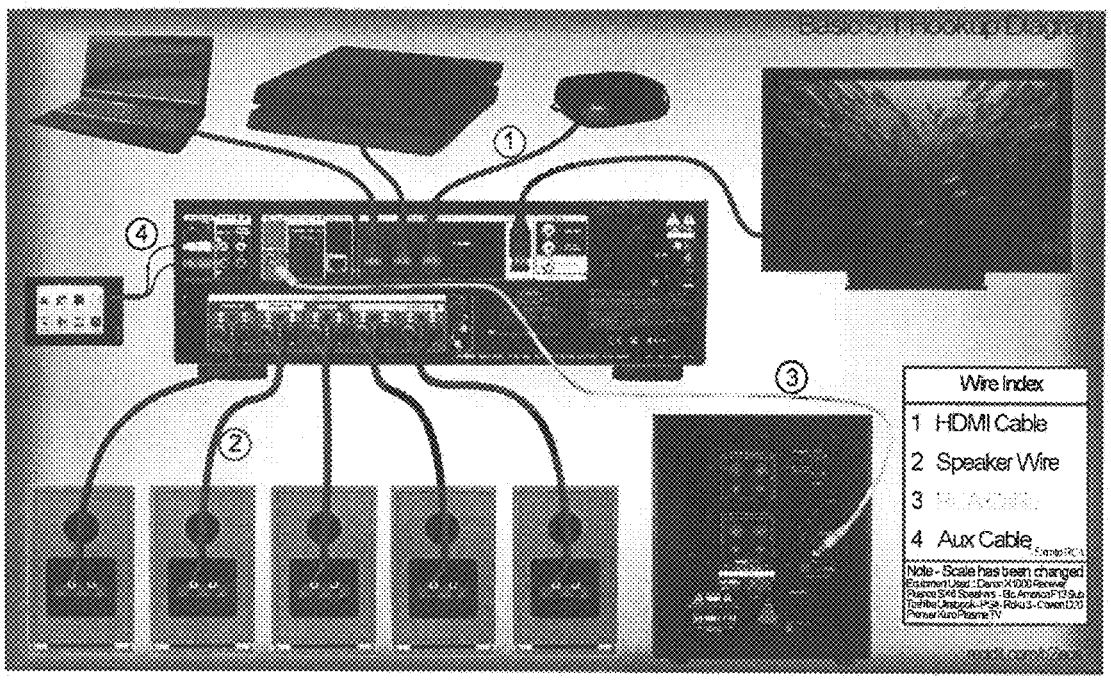
FIG. 2 illustrates a consumer entertainment system.

Architecting media systems around a sophisticated central device has been the prevailing practice for many decades. This is because media systems, by their very nature, require synchronization and control coordination of all audio and video streams. Historically, the only technically viable and cost-effective way to implement the needed synchronization, control, and functionality has been to incorporate all of the "intelligence" in a sophisticated central device and utilize point-to-point connections that carry only a media stream, to relatively less sophisticated end points.

However, when media systems utilize this central device architecture, the intrinsic feature set and capacities of the central device imposes constraints on the media system as a whole. In particular the central device determines the media system's capacity, as measured by the number of endpoints (both input and output devices) that can be accommodated. In particular, the central device also determines the media system's set of processing features. In particular, the central device may further determine the media system's control mechanisms and methodologies.

Expanding either the system capacity or the feature set or changing the system control mechanisms (for example to provide remote control via a tablet) generally means replacing an existing central device with a more capable one. Furthermore, connecting a sophisticated central device to the endpoint devices using point-to-point links that carry no information other than the media stream itself results in media systems being very complex to configure, being subject to frequent configuration errors that are difficult to find, and being very complicated to operate. In general, sound reinforcement systems built around audio mixing consoles or consumer entertainment systems built around A/V receivers are difficult and complicated to configure and operate.

High capacity digital networking may be used as a communication backbone to facilitate re-architected media systems in ways that facilitate many compelling advantages. One of the resulting advantages, with a suitably re-architected media system is to greatly simplify the tasks of configuring and setting up a media system. Another of the resulting advantages, with a suitably re-architected media system is allowing media devices to be dynamically inserted into and removed from a functioning media system with plug and play simplicity. Another of the resulting advantages, with a suitably re-architected media system is to significantly improving ease of operation. Yet another of the resulting advantages, with a suitably re-architected media system is enabling a media system's capacity to scale incrementally without obsoleting or needing to replace other components. Yet another of the resulting advantages, with a suitably re-architected media system is allowing additional functionality to be introduced without obsoleting or needing to replace other components. Moreover one of the resulting advantages, with a suitably re-architected media system is reducing the number of components needed to implement a media system.

Figure 3:
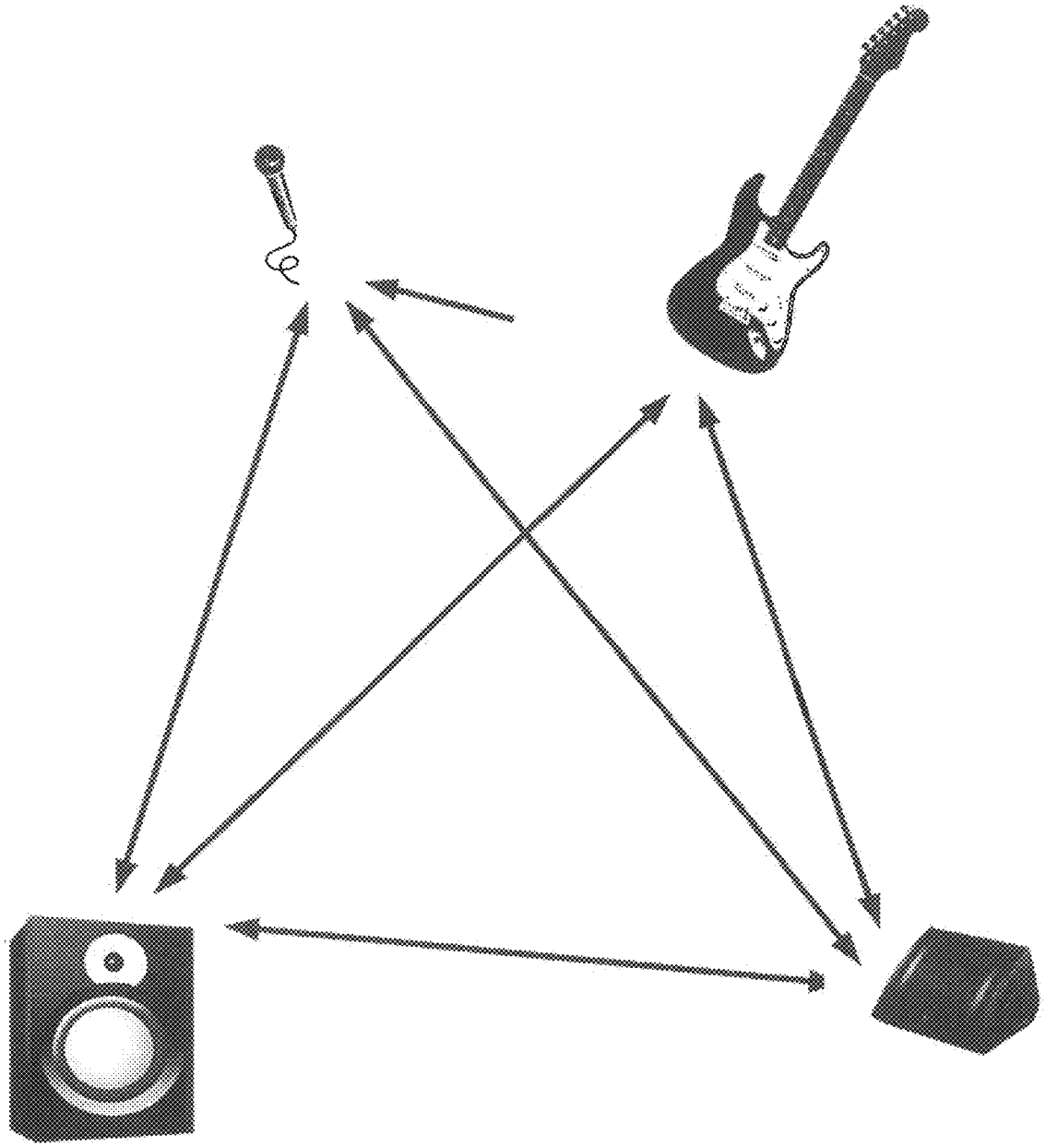
FIG. 3 illustrates a set of smart devices in a peer to peer network configuration.

Referring to FIG. 3, it is desirable to make each endpoint device of a media system smart by directly incorporating media processing capabilities appropriate to the endpoint type (input or output) and connecting each smart endpoint device via a packet-switched digital network communication system. A system control protocol may be implemented in a distributed fashion across all of the smart endpoint devices. Collectively, the smart endpoint devices implement all of the required functionality while also enabling additional functionality. In general, each of the smart devices include a processor and memory, together with input and/or output to the network, and input and/or output to an audio source (as an example) and/or a speaker source (as an example).

The intelligence and functionality that used to be instantiated within a sophisticated central device is thus moved out, at least in part, to the smart endpoint devices which operate in a peer-to-peer fashion among other smart endpoint devices. This peer to peer approach eliminates the need for a sophisticated central device and the attending limitations imposed by such devices.

Figure 4:
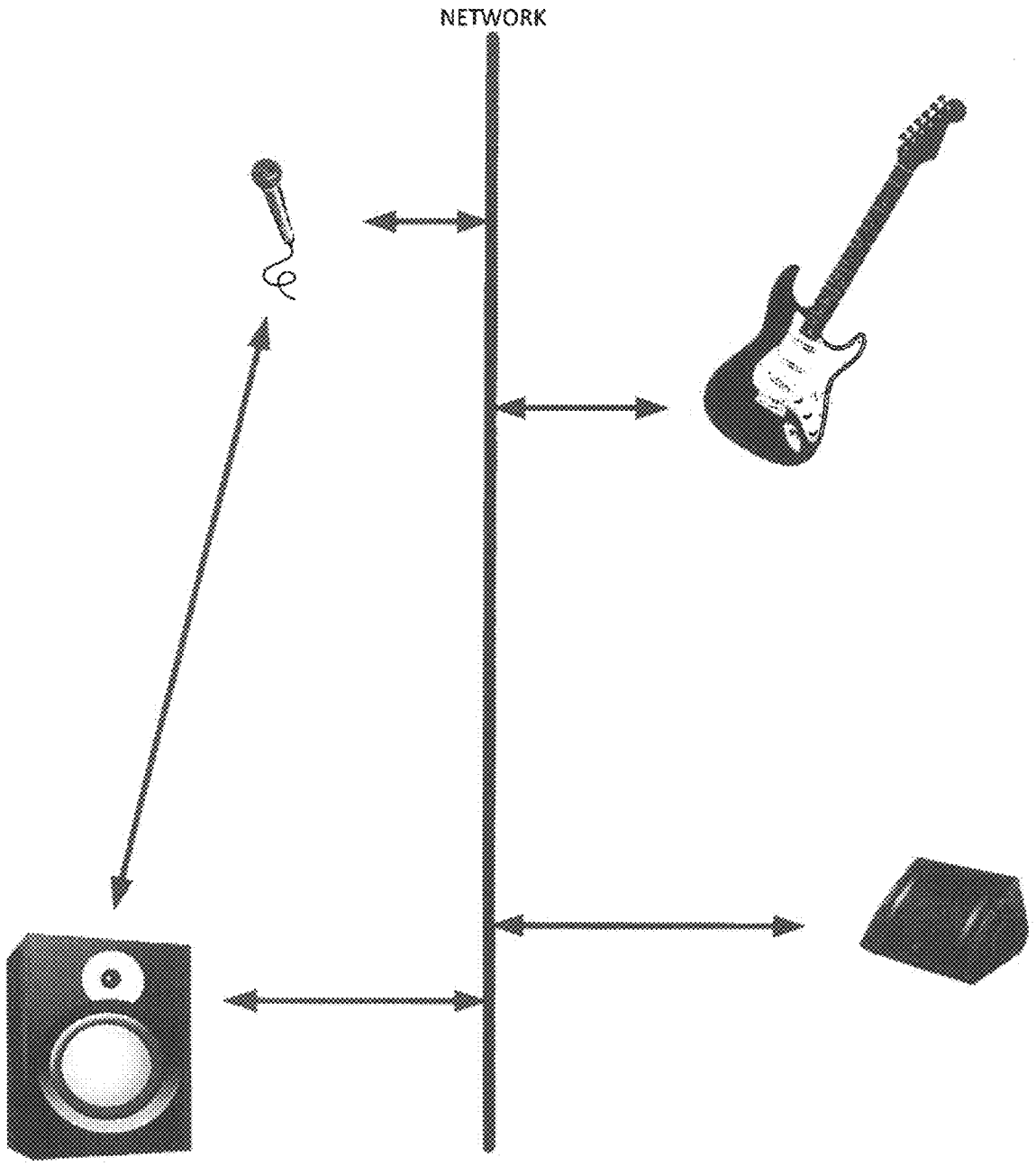
FIG. 4 illustrates a set of smart devices in a peer to peer configuration together with a network.

Referring to FIG. 4, the digital network enables each smart endpoint device to directly communicate with every other device using both point-to-point and point-to-multipoint transmission methods. The connection topology is peer-to-peer. The network simultaneously carries multiple synchronized media streams, metadata associated with media streams, and the messages needed for the endpoint devices to collectively implement the system control protocol.

The system control protocol allows endpoint devices to be dynamically inserted or removed from the media system, using any available network port, with plug and play simplicity. Adding an endpoint device to the system may be as simple as connecting a USB mouse to a personal computer. Upon adding an endpoint device to the network, it just shows up and is ready to be used. Thus no central panel needs to be configured to incorporate a new endpoint device.

Figure 5:
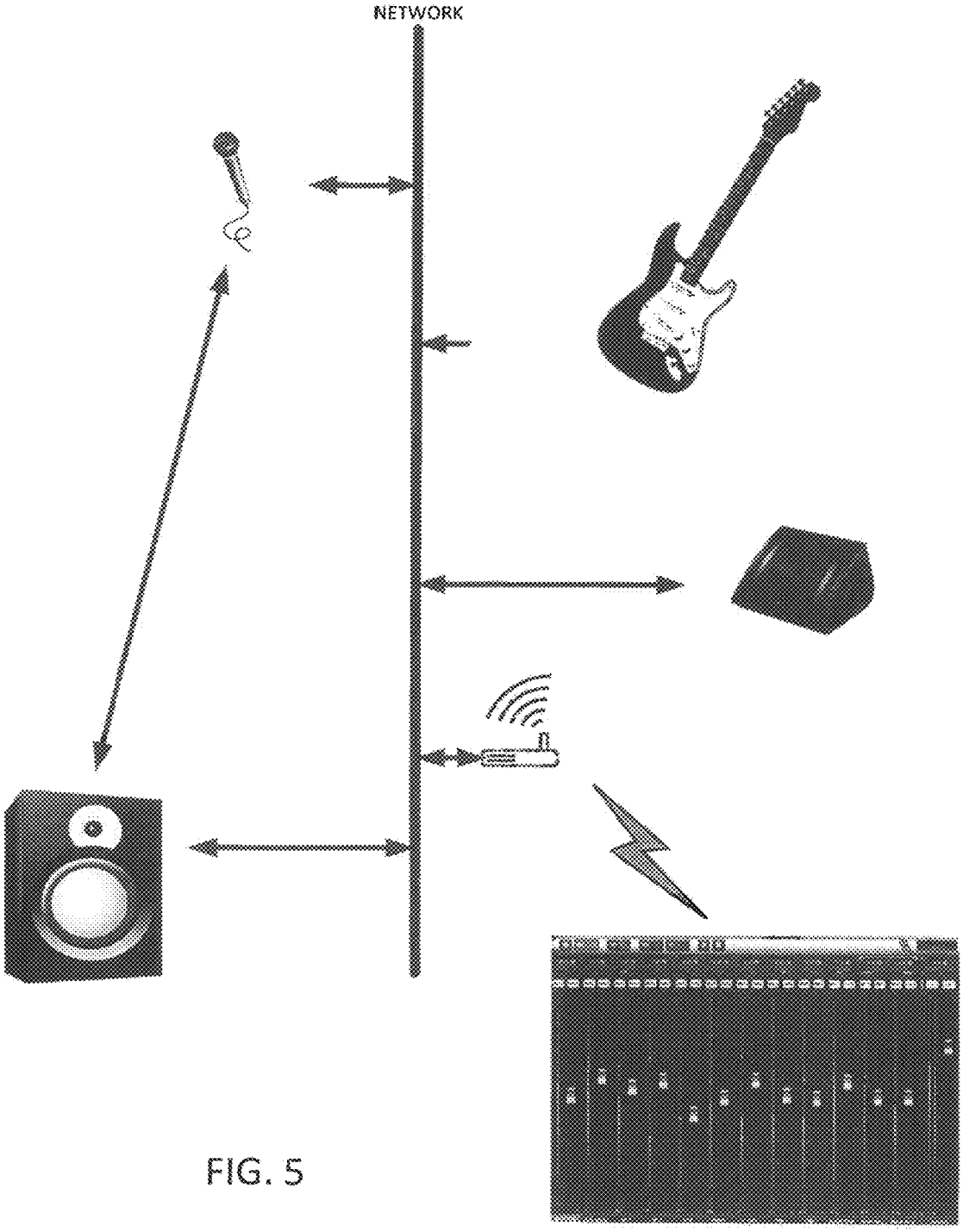
FIG. 5 illustrates a set of smart devices in a peer to peer configuration together with a network and a control panel.

The system control protocol also ensures that all media streams are properly synchronized and automatically routed from input devices to output devices with no operator intervention required and with very low latency. It maintains overall system state in a cohesive and robust manner. It also provides all of the information needed for a user employing a control application, typically (though not necessarily) running on a mobile device, to see all of the connected components and easily operate the system as desired, as illustrated in FIG. 5.

While the media system is operating, each smart input device multicasts its media streams on the network to all smart output devices, preferably including itself. System control messages also broadcast on the network instructing each smart output device as to how it should combine and enhance the received audio streams or select from amongst (and then possibly also enhance) the various video streams in order to render the specific output (sound or video image) that is needed from it.

Figure 6:
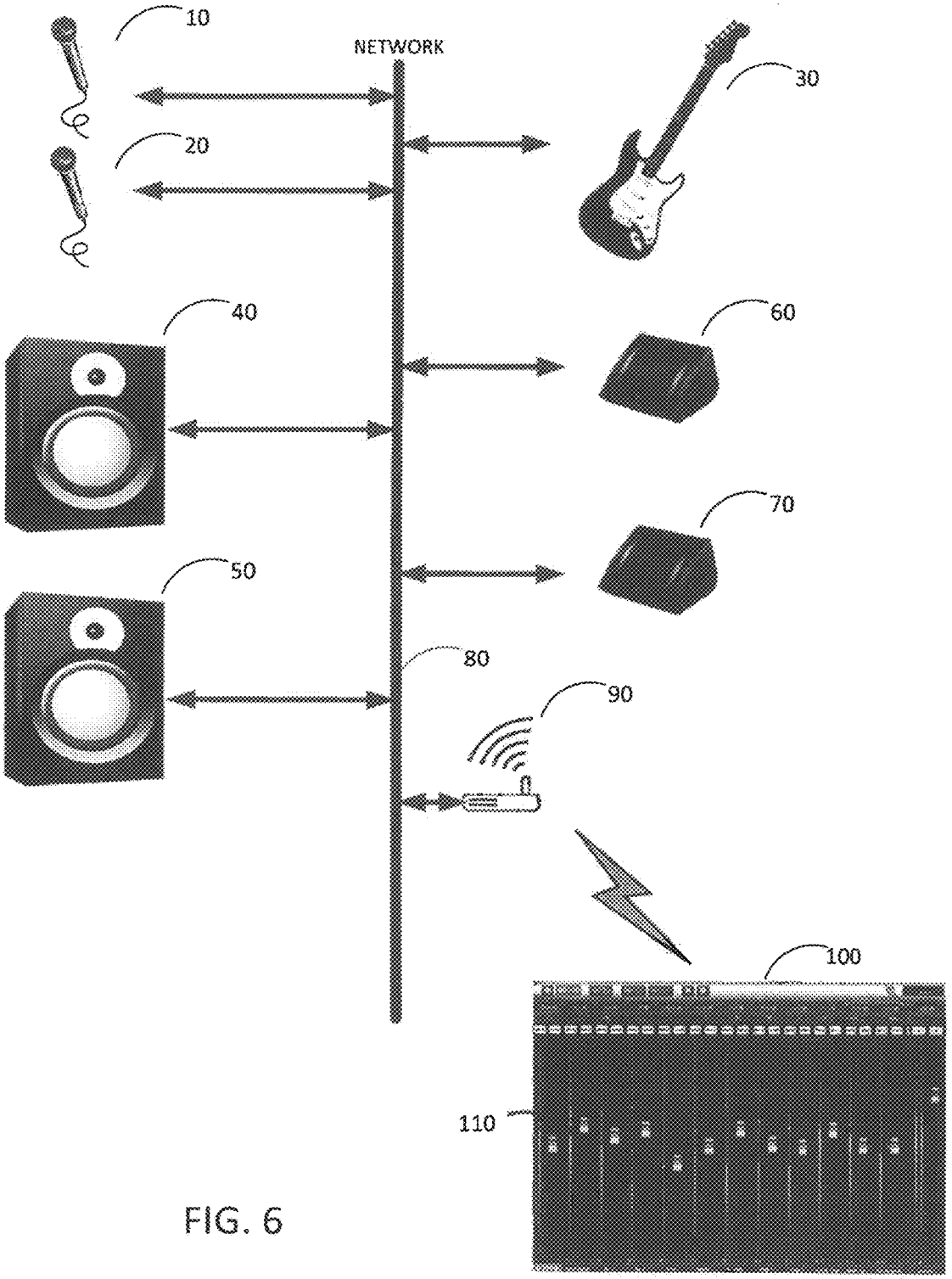
FIG. 6 illustrates another set of smart devices in a peer to peer configuration together with a network and a control panel.

Referring to FIG. 6, a sound reinforcement system is illustrated. Each of the various components are connected to the digital network 80 using any convenient port. Since this system preferably utilizes Ethernet for the digital network, devices would be connected to ports on one or more Ethernet switches. Unlike conventional sound reinforcement systems, it does not matter which port each component is plugged into.

For example, the sound to be reinforced may originate with two smart vocal microphones 10 and 20 and a smart electric guitar 30. Each of these input devices multicast their corresponding input audio stream to each of the smart output devices. The sound heard by the audience is as a stereo sound image produced by the combination of smart speakers 40 and 50. The performers use smart stage monitors 60 and 70, each of which produces a separate mono sound image, to help them hear better and thus perform better.

A WiFi adaptor 90 is also connected to the digital network 80, to allow a WiFi enabled tablet device 100, running a system control application 110, to act as the system control device. The various media streams preferably do not flow over the WiFi link in order to avoid a significant increase in end-to-end system latency, and to avoid overwhelming the WiFi link with high traffic levels.

As it may be observed, no central mixing console or mixing engine is needed since all of the media processing may happen directly in the various endpoint devices. End-to-end system latency remains at a low value (approximately 2 ms) because each media stream is transmitted through the network exactly once.

Furthermore, because the system is controlled via a system control protocol, multiple instances of the control application can be run simultaneously on separate mobile devices. Performers could use their personal smart phones to control their own monitor mixes, while a sound engineer uses a tablet device to control the sound the audience hears. If desired, a hardware audio control surface with multiple faders, knobs, and switches could also be used to control the system. In this case software running on the control surface would translate between hardware control settings and system control protocol messages.

There is functionality that is preferably common to all smart audio endpoints. In the description provided herein, "endpoints" and "devices" are used interchangeably to describe devices that are used for input and/or output. One of the characteristics of most devices described herein is that each device provides either audio input and/or audio output, though preferably in most cases not both (although in limited cases, such as an intercom headset, both input and output may exist in the same enclosure, though they remain functionally independent). Input devices and output devices may be combined into a single package, but each side acts as an input or output device separately. There is preferably no "short-cut" connection between input and output of a particular device. In this manner the output is provided to the network from a device and the input is received from the network for the same device. As described the input devices and output devices—which primarily convert audio between the analog and digital domains—network connectivity, audio sample rate coordination, and implementation of the system control protocol are consistent for all devices.

With respect to network connectivity, devices may have a connection to a digital (normally packet-switched) network such as an Ethernet network. This Ethernet connection is based on industry standards, and may use both layer 2 (Data Link) and layer 3 (IP Network) protocols for various purposes. Data rates are preferably at least 100 Mbs, but can be gigabit or faster. Because the network connections use industry standards, virtually all commercially available network equipment (such as network switches) may also be used. Power for endpoints can (optionally) be provided by using Power Over Ethernet (POE). POE may be required for devices that do not have another power source. Physical Ethernet connections may be based on industry-standard RJ-45 connections, but may also be made using more robust Ethercon™ connectors, which are also fully compatible with RJ-45 connectors.

With respect to system wide clocking, system devices are preferably synchronized to a common digital clock. This may be done through an implementation of the industry standard IEEE1588-2008 protocol, often referred to as Precision Timing Protocol (PTP). PTP requires one device to act as the clock master, while all other devices follow. As an industry standard, the IEEE1588-2008 specification provides information on how the best master clock is selected among available devices. Such a master-clock mechanism is used in a peer-to-peer environment, where devices may join or leave the network at any point in time. When a device that is acting as master clock is removed from the network, another device then provides the master clock service. IEEE 1588-2008 also allows for others clocks, such as clocks that are highly precise (GPS-based, for example) to provide master clock services.

With respect to audio sample rate coordination, every device on the network using network timing provided by PTP, the sample rate used to convert analog signals to digital, or to convert from digital signals to analog—a capability used by smart audio devices, may be tightly coordinated. In fact, the sample rates on all smart devices on the network are preferably aligned with one another. Accordingly, the sampling rate should be the same for all the smart devices, and if a particular device has more than one potential sampling rate it should select a sampling rate that is common to all the other devices on the network. Even minor changes in audio sample rates may result in undesirable audible effects including pops, clicks, and jitter. All smart devices may use an aligned audio sampling rate to maintain synchronization of audio sampling across all devices on the network. Each device may be periodically checking sample rates and, as needed, making relatively minor adjustments in its sampling rate to maintain precision. This audio timing mechanism may use the capabilities of a system control protocol to maintain precision and minimize jitter.

With respect to the system control layer, distributed implementation of the system control protocol across all of the smart input and output devices provides added functionality. The distributed nature of the functionality permits independent and disparate media devices to act cohesively and collectively as one system, even as any device may be dynamically removed from or inserted into the system. To accomplish this, the system control protocol uses characteristics of digital networks including both point-to-point and multipoint transmission modes, and the ability to simultaneously carry multiple high bit rate, uncompressed media streams, as well as metadata, control commands, and status information. The system control protocol may be a coordinated set of instructions designed to make each device respond and act in the manner desired. The control protocol may have two layers—the hardware control layer and the application control layer.

With respect to the hardware control layer of the system control protocol, it is used to keep all devices and endpoints coordinated. Hardware control instructions are transmitted and received by endpoint devices only. No centralized processor is used for the hardware control layer. In that sense, the system is a true peer-to-peer system.

To make this system operate more efficiently, each device may be a master of itself only. This may be referred to as a single mater rule. Each input device maintains the settings for itself as an input, and each output device maintains the settings for itself as an output. If another device needs to know something about one of the other devices, it gets that information from the other device directly. The various devices preferably communicate their master information to many other devices frequently without necessarily receiving a request so that all devices can maintain updated information.

The hardware control layer provides low-level functionality by communicating settings to various devices on a need-to-know basis. For example, an audio input device may, as single master, maintain settings for volume. That information, however, is utilized on an audio output device. The input device, as single master, may communicate to the audio output device what that volume setting is, and update the output device whenever it changes. Because of the single master rule, many output devices are able to track the volume for each individual audio input device, and maintain control synchronization. The hardware control layer is normally implemented at the data link layer of the packet-switched network. Other data may be provided by the input device that is then used by the output device or other input devices.

The application control layer provides a mechanism for applications external to the device to control the parameters of the various devices. The application control layer is normally implemented on the network layer of the packet-switched network using standard Internet protocols such as UDP and TCP/IP. Using the application control layer, applications can query current settings and command new settings on the various endpoint devices. For example, if an application desires to change the volume for a specific device, the application control layer is used to make the request of the device (which is the single master) for the new value. The requested device responds when the change has been successful.

With respect to a capability discovery mechanism, the application control layer is dependent upon a description of the capabilities, present (and potentially unique) in each device. This description is referred to as a "schema". Each device has a schema that describes the functions, settings, attributes, and capabilities of that device. Each device can have a different schema. While many schema entries are common between devices (such as volume), some devices have schema entries for functions or capabilities that are unique to that device. For example, a speaker might have the capability of changing the crossover frequency. Control applications utilize schema information to know how to properly present the control capabilities of each device.

With respect to discovery and admission control, as smart endpoints are connected to the digital network they implement a discovery protocol to detect already connected system components and determine which component is currently acting as the master with respect to admission control. Devices then report in with the master and seek admission to the system. At this point, without any operator intervention, devices just appear on the control application.

Based on operator preferences, the master appropriately facilitates several admittance scenarios. One admittance scenario may be clean start—a device with all default settings is connected to the network and seeking to be admitted. Another admittance scenario may be transfer in—a device that still contains settings and metadata from its use in a previous performance seeks to be admitted. A further admittance scenario may be re-admittance—a device that had been operating in this system but went offline, due, say, to a brief power failure, is seeking to be readmitted.

Admission policies makes it possible for devices being re-admitted to quickly reappear on the operator's display without intervention, while also allowing the operator to decide whether other devices will be automatically admitted or admitted only after being re-initialized and only when the operator is ready. If at any time the device that is currently acting as master for admission control goes off line, the remaining devices will readily select a successor. In this eventuality no loss of state occurs, because the master device keeps other devices constantly updated and ready to step in if needed.

With respect to routing and disseminating input media streams to all output devices, as part of the admission process, input devices may be provided with network addresses to be used to multicast their input streams and corresponding mix-specific metadata. Once admission has taken place, input streams for unmuted devices are sent continuously to the designated network addresses. This mechanism eliminates the need for an operator to be involved in configuring and mapping signal paths. The input streams from all input devices are simultaneously available for consumption by all output devices. It also ensures a very low and constant end-to-end latency, since audio streams are sent across the network exactly one time.

With respect to grouping, another capability of the system is the ability of each device to be "grouped" with other devices. For example, a group of microphones that are used for backup vocalists, can be grouped together with a common volume or mute control. Grouping may be based upon tight coordination between devices at the hardware control layer, as well as at the application control layer. Groups create new virtual objects, which act like a device, but are not actually a physical implementation of such. Information about the virtual object resides in all group members, however to maintain the single master rule, only one device acts as the group master. Groups may be added or removed. Grouping may also be hierarchical, meaning a group can be a member of another group. Grouping is useful in reducing the complexity presented to a system operator. Instead of seeing faders for all 8 mics used on a drum kit, for example, the operator can see just one for the entire group.

With respect to robustly maintaining system state, the device acting as admission control master may also have the job of maintaining overall system state. This consists of a number of settings, policies, and assigned values that all components, including system control applications, may need to access. When a change in system state is made by, say, an operator using a system control application, the new value is sent to the master device which in turn makes it available to all other devices. Redundant copies of system state information is maintained in other devices so that "instant" failover can occur should the master device go offline.

With respect to persistent storage, all devices may include non-volatile memory for remembering hardware control settings, application control settings, and group membership information even when powered off. This allows devices to be removed from the network, then come up again as they were previously. Maintaining non-volatile memory across a distributed peer-to-peer system is facilitated as a result of the single master rule and coordination at the hardware control layer.

As illustrated in FIG. 6, devices 10, 20 and 30 are considered smart input devices. Examples of smart input devices include microphones, musical instruments, and audio playback devices. By way of example, the term "smart" may reference, that at a minimum each devices includes one or more of the following. The device may communicate via a digital network 80, which may be for example, an Ethernet connection. The device may synchronize itself to a system-wide clocking signal transmitted via the network. The device may utilize the system-wide clock to synchronously convert audio signals from the analog to the digital domain. The device may use multicasting of one or more digital audio streams to smart output devices. The device may make real-time input level metering data available to all instances of system controllers. The device may send device status information and receive commands to set device modes and parameters. The device may retain operating parameters and metadata in non-volatile storage. The device may implement system control protocols. The device may include a firmware update mechanism, error logging, and direct device interrogation via network protocols.

In addition, each smart input device may also keep track of a comprehensive set of parameters that instruct smart output devices regarding how the input device's media stream is to be processed when creating the various output mixes. This includes input fader level, multiband equalization settings and/or effect send levels to adjust the amounts of effects such as reverb or echo to be applied. These mix-specific parameters are transmitted throughout the system as metadata that is associated with the device's media stream.

Implementing the smart input device functionality directly within the device itself enables delivery of all the features in an error-free basis, together with true plug and play simplicity for both system setup and subsequent operation.

Figure 7:
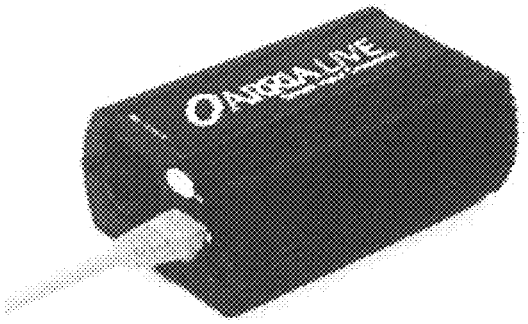
FIG. 7 illustrates an audio input converter.

Referring to FIG. 7, to accommodate legacy microphones, instruments, and other sound sources that do not incorporate the requisite intelligence, a sound reinforcement system may also employ one or more audio input converters that allow such devices to supply an analog audio signal to the system via a legacy analog cable. Preferably, the audio input converter includes 2 or more connectors: a combo connector that accepts either a standard XLR audio cable(s) or a ¼" audio cable(s) (such as would typically be used for an electric guitar), and an Ethernet connector. The audio input converter implements the smart functionality enumerated above for smart input devices, while also receiving the legacy audio input. Other versions of audio input converters can also be constructed that accommodate other types of audio connectors and signals including, for example, a converter that accepts line level stereo signals such as would come from a personal media player.

Because control settings and metadata are stored within the converter on behalf of the associated legacy audio source, it is preferable to preserve a one-to-one relationship between each legacy audio source and its corresponding audio input converter.

In an alternative instantiation, one may gang together multiple audio converters into a single physical device with multiple analog input connectors and a single, shared, network connector. In order to avoid the configuration errors that could otherwise easily occur with such an instantiation (for example, mistakenly plugging a guitar into an input port where a drum was expected) it is preferable that a process be provided for the system to automatically determine which analog source device is connected to each input port.

This can be accomplished by embedding a tiny digital integrated circuit chip inside the analog source device (for example a microphone or guitar) when it is manufactured or, in the case of an existing device, within the device's existing analog connector. This integrated circuit chip receives power through and communicates digitally over the existing analog cabling. The presence of this chip does not in any way alter or degrade the functionality of the analog endpoint device. Further, circuitry within the audio input converter interacts, via the analog cabling, with the digital chip added to the analog source device, and thereby retrieves from it a unique digital identifier. This unique identifier is then used to access the set of operating parameters and metadata that is to be associated with the connected analog endpoint device.

As previously described, increasingly, digital technology is being used within media systems to transport media signals to and from the various endpoints (including microphones, speakers, cameras and displays) as well as to and from any central controller that may exist. It is also common for the functions of processing, mixing and switching of media signals to be done with digital technology. However, with most media systems, it is still necessary to connect numerous analog endpoints, such as microphones and speakers, to system media ports that convert between the analog and digital domains. These connections are made using analog cables and connectors which currently provide no means for a digital media system to unambiguously determine which specific analog endpoint device is being connected to a given input or output port. Typically a media system is configured by its operator to expect specific analog endpoint devices to be connected to specific ports, and the system will operate correctly only if the connections are made as expected. It is very common for errors to be made when setting up complex media systems, especially when it comes to connecting analog endpoint devices. Since the media system has no way of independently determining whether the analog devices were in fact connected as expected, if the system does not operate correctly it is incumbent upon human operators and technicians to perform complex and time consuming troubleshooting in order to find and fix the problems.

It is desirable in one embodiment to facilitate the digital media system to unambiguously determine which specific analog endpoint device is connected to each analog connection port, even while using existing analog cables and connectors, and without in any way interfering with the ability of such cabling and connectors to convey the analog signal. Further, it provides a way for a media system to persistently associate parameters and metadata with a specific analog endpoint device. In one embodiment, this is accomplished by embedding an integrated circuit chip inside the analog endpoint device when it is manufactured or, in the case of an existing device, within the endpoint's existing analog connector. This integrated circuit chip receives power through and communicates digitally over the existing analog cabling. The presence of this chip preferably does not in any way alter or degrade the functionality of the analog endpoint device. Further, circuitry may be added to the media system's analog connection port that can interact, via the analog cabling, with the digital chip added to the analog endpoint device, and retrieve from it a unique digital identifier. This unique identifier is then used to access a set of operating parameters and metadata that is associated with the connected analog endpoint device.

Figure 10:
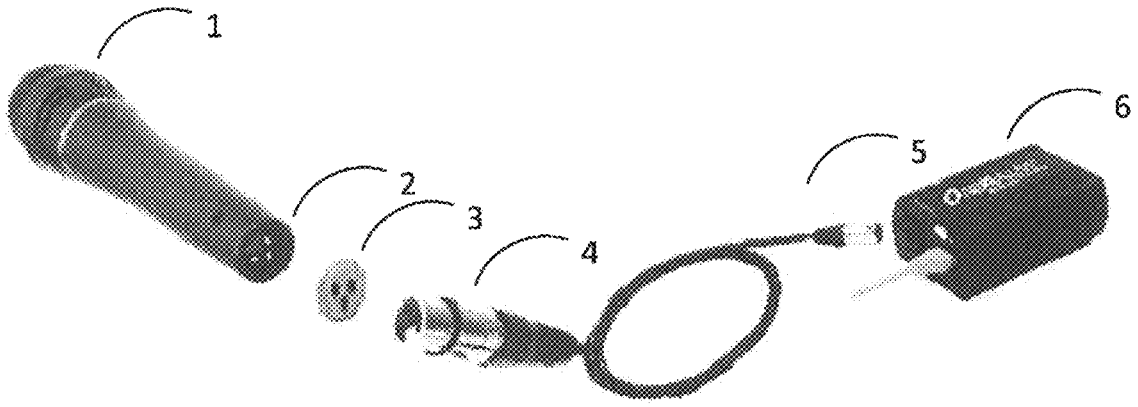
FIG. 10 illustrates another smart device.

Referring to FIG. 10, one embodiment includes a microphone (1) that has an integrated male XLR (or other) connector (2). A digital chip may be embedded in a thin disc (3) (or otherwise) that fits over the pins of the male XLR connector. A standard analog microphone cable with a female XLR (or other) connector (4) may connect to the microphone and mechanically mate properly. The other end of the microphone cable (5) connects to a media port (6) of a digital media system.

Figure 11:
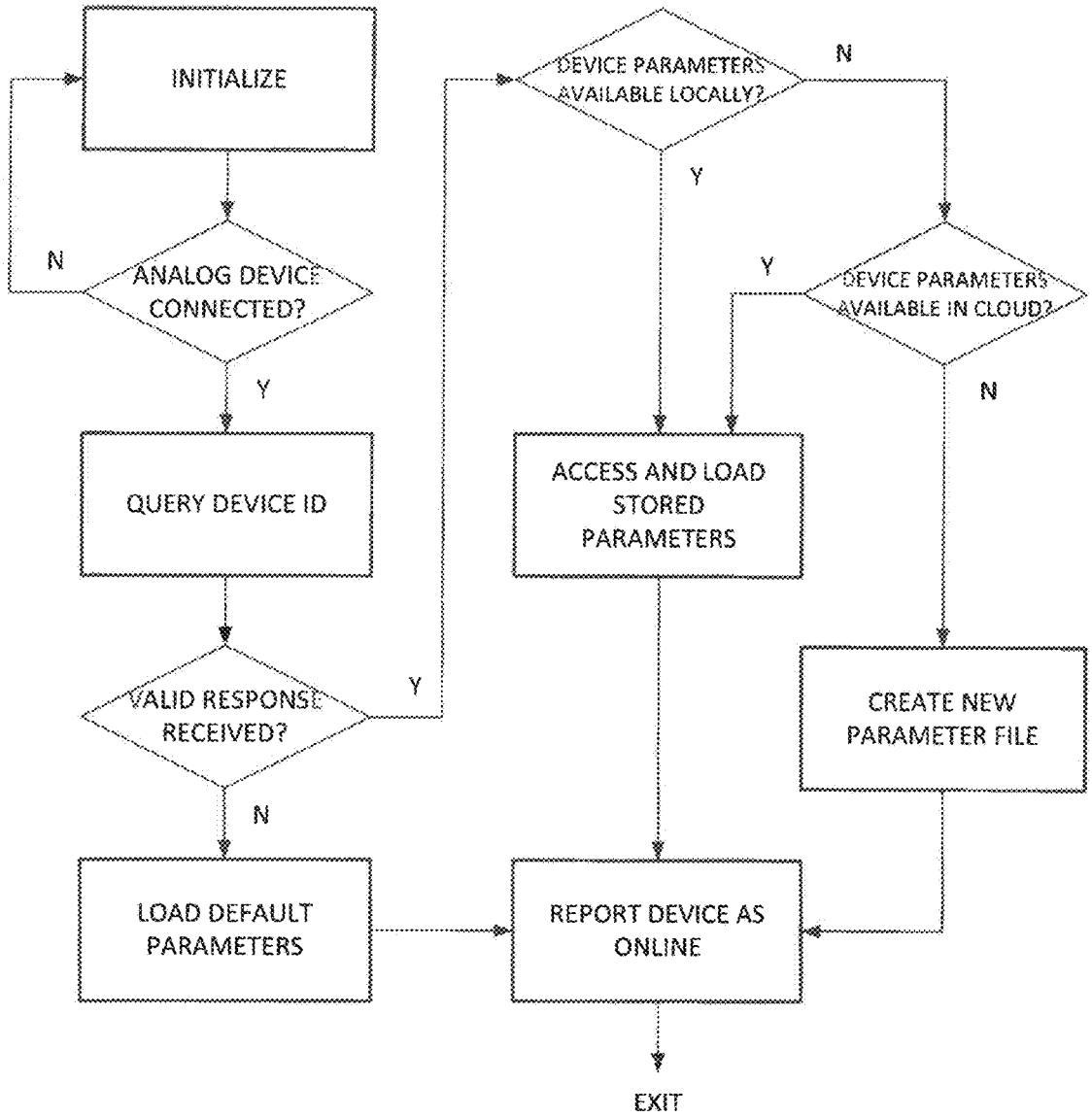
FIG. 11 illustrates a logic diagram for a system including the smart device.

Referring to FIG. 11, a logic flow that may be used within the media port is illustrated when an analog endpoint device, that includes the structure described with respect to FIG. 10, is connected to the media port. The flow includes initialize followed by whether an analog device is connected? If an analog device is connected it queries the Device ID. If no valid response is received, then it loads the default parameters and reports device as online. If a valid response is received, then it is determined whether the device parameters are available locally. If they are available locally, they are accessed and then load the stored parameters. Then the device is reported as being online. If the device parameters are not available locally, it is determined whether the device parameters are available in the cloud. If they are available in the cloud, they are accessed and then load the stored parameters. Then the device is reported as being online. If the device parameters are not available in the cloud, then a new parameter file is created, loaded, and the device is reported as online.

In the ideal case, a digital media system will have both operating parameters (such as gain and equalization) and metadata (such as device type and model, assigned device name and assigned function) associated with each endpoint device. This makes it possible for correct and consistent operating parameters to be assigned each time the device is connected to the media system, and provides a wealth of very useful information for the operator. This association of operating parameters and metadata with a specific endpoint is reasonably easy to do with digital endpoints, but up until now has not been feasible with analog endpoints. However, a media port, which transforms analog signals to or from the digital domain would be capable of associating such operating parameters and metadata with a specific analog endpoint device if there were a way to uniquely and unambiguously identify the particular device connected to it.

Digital integrated circuit (IC) technology may be used to assign a globally unique identifier to each analog endpoint device. It takes advantage of very tiny IC chips that come pre-programmed with a 64 bit or larger identifier, and can be powered and interrogated by unobtrusive means such as radio frequency waves or low voltage pulses on a signal line. Typical examples of this type of technology include radio frequency identification (RFID) tags and 1-Wire products from Maxim Integrated Inc.

Because the IC device is so small it can be easily integrated into an analog endpoint device at the time of its manufacturing. It can also be attached in a secure yet unobtrusive way to an existing (i.e. already manufactured) analog endpoint device, thus providing the analog device with a unique digital identifier. In one embodiment depicted in FIG. 10, a typical vocal microphone (1) is provided with a unique digital identifier as follows. A 1-Wire IC is embedded within a disc-shaped plastic substrate (3) with a thickness of less than 75 mm. This disc's diameter allows it to fit within the shell of the microphone's integrated XLR connector (2), and the disc has holes drilled that will fit over and make electrical contact with the 3 pins of the XLR connector. The 1-Wire IC is small enough to fit comfortably between the 3 XLR pins, and the plastic disc is thin enough that it does not prevent a female XLR connector (4) from mating and securely locking as it is designed to do. With proper design tolerances, the disc will not fall off the end of the microphone, even when no connector is attached, but, if necessary, can be removed. In a different embodiment of the invention, which is not illustrated, a RFID tag could be used in place of the 1-Wire IC.

Once an analog endpoint device has been appropriately fitted with an identifier IC, the circuitry within the media port (6) may interrogate the device and read its unique identifier. In the case of a 1-Wire IC, this is done by sending a series of low voltage pulses over one of the XLR signal lines. These pulses provide the power needed to operate the 1-Wire IC and instruct it to provide it's own pulses onto the signal line that correspond to the device's unique identifier.

In the case of an RFID tag, the media port would impose a low power RF signal onto the XLR wires which would be received by the RFID tag, cause it to power up and to modulate the received RF signal with its assigned unique identifier. The media port detects and decodes the modulated RF signal to recover the transmitted identifier.

While low voltage pulses or RF signals do not harm the microphone (1) in any way, it is recommended that this interrogation happen during the few milliseconds after the analog endpoint device is first connected and before its analog signals are converted to or from the digital domain. There are several well-known techniques for the media port to use in order to determine whether or not an analog endpoint device is currently connected. These include monitoring changes to input impedance or detecting analog signal activity above an established threshold.

As illustrated in the logic diagram of FIG. 11, there are 3 possible outcomes of the analog endpoint interrogation process. If the interrogation process was not successful in receiving a unique identifier, the media port does not know anything about the particular analog endpoint device connected to it, and must assume a default set of parameters and metadata that are used for all unidentified devices. If the interrogation yields a unique identifier then the media port must determine whether it has already seen this device before and has the appropriate parameters and metadata stored locally. If the media port has not seen this device before (or perhaps, not recently enough), and if Internet connectivity is available, it can query a cloud-based database, using the device's identifier as an index, to retrieve the needed operating parameters and metadata. If operating parameters and metadata are not available either locally or from the cloud, the media port will create a new data set using default values that are designated for use with identified but heretofore unfamiliar devices. As the media system is operated, updates will occur to the operating parameters, and may occur in the associated metadata as well. The media port will retain these changes in its local store, and, if configured to do so, may also update the cloud-based data store as well.

Once an analog endpoint device has been assigned a unique identifier and connected to the media system via one media port, it can be disconnected from that media port and re-connected on any other media port and its operating parameters and metadata will follow it. Thus imagine a stage box consisting of dozens of XLR connectors, each associated with a media port. The technician setting up a media system no longer needs to worry about which XLR connector each analog endpoint is connected to. It no longer matters. The media system will discover and correctly configure the analog endpoint regardless of which physical XLR connector is used.

If a cloud-based data store is utilized, a microphone can be moved from one venue to another venue and it's operating parameters and metadata will still follow it. Thus for example, a vocalist may own a personal microphone which has been configured to sound just the way they like it, and which includes metadata identifying it as their personal microphone. Whenever they plug their personal microphone into a digital media system equipped with this invention, no matter what venue they are at and no matter what port they plug it into, the microphone will be identified as their personal microphone and have their preferred operating parameters established.

In general, another embodiment enables a technique to associate a globally unique digital identifier with analog endpoint devices used in conjunction with digital media systems including professional and consumer audio-video entertainment systems for live performance, streaming media, or recorded media.

In general, another embodiment enables a technique to associate a globally unique digital identifier with an existing (i.e. already manufactured) analog endpoint device in such a manner that its operation is not in any way impacted or adversely affected.

In general, another embodiment enables a technique to interrogate an analog endpoint device's associated digital identifier over existing analog cabling and analog connectors.

In general, another embodiment enables a technique for associating both operating parameters and metadata with individual analog endpoint devices that have been assigned a digital identifier.

In general, another embodiment enables a technique to store operating parameters and metadata associated with a particular analog endpoint device local to a media system so that the analog endpoint device can be connected to any available media port.

In general, another embodiment enables a technique to store operating parameters and metadata associated with a particular analog endpoint device in the cloud so that the analog endpoint device can be connected to any available media port on any properly equipped media system anywhere in the world and have the proper operating parameters and metadata follow the analog endpoint device.

The smart audio output devices 40, 50, 60, and 70 will most often be instantiated as a powered speaker, an audio amplifier that drives a passive speaker, a network-connected pair of headphones, and/or an audio recording device. Smart output devices are preferably capable of one or more of the following. One capability of the smart output device is communicating via a digital network 80. Another capability of the smart output device is synchronizing to a system-wide clocking signal transmitted via the network. A further capability of the smart output device is receiving one or more multicast digital audio streams along with mix-specific metadata from other system components. Yet another capability of the smart output device is implementing mix-specific instructions associated with each incoming media stream to combine and enhance the received audio streams, producing a digital "mix" that is specific to this particular output device. Another capability of the smart output device is providing real-time output level metering data to all instances of system controllers. Another capability of the smart output device is utilizing the system-wide clock to synchronously convert the digital mix signal into sound emanating from the associated speaker. Another capability of the smart output device is sending device status information and receiving commands to set device modes and parameters. Another capability of the smart output device is retaining operating parameters and metadata in non-volatile storage. Another capability of the smart output device is implementing speaker management functions. Another capability of the smart output device is implementing the system control protocols. Another capability of the smart output device is providing firmware update mechanisms, error logging, and direct device interrogation via standard Internet and worldwide web protocols.

As a convenience to system designers and installers, smart speakers may also include speaker management functionality. Since many of these speaker management parameters are set according to a speaker's installed location within a venue and the speaker's physical characteristics, provision is included to lock these settings so that they are not changed inadvertently. Speaker management functionality may include one or more of the following: crossover settings, feedback suppression, delay, pink noise generation, tone generation, and/or level adjust.

As with smart input devices, the benefits are preferably implemented directly within each smart audio output device. Since speakers and amplifiers are usually physically larger and more expensive devices, embedding this functionality is usually quite feasible.

Figure 8:
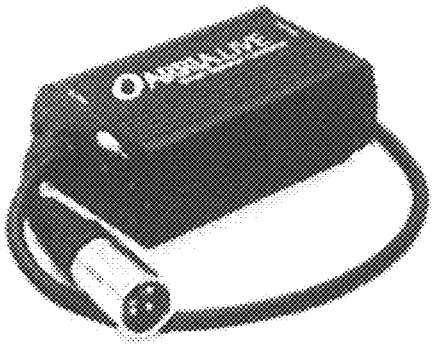
FIG. 8 illustrates an audio output converter.

Referring to FIG. 8, where there is a need to use existing, non-smart sound output devices, such as speakers that are already installed within a venue, it may be desirable to utilize one or more smart output converters. This smart output converter may provide 3 connection points: a short audio cable with a male XLR audio connector, an Ethernet connector, and a female XLR connector. The male XLR cable provides a line level audio output that can be plugged directly into either a conventional powered speaker or into an audio amplifier. The inclusion of a female XLR connector, which accepts a line level analog input signal, allows the converter to be inserted in parallel with an existing legacy sound reinforcement system.

Figure 9:
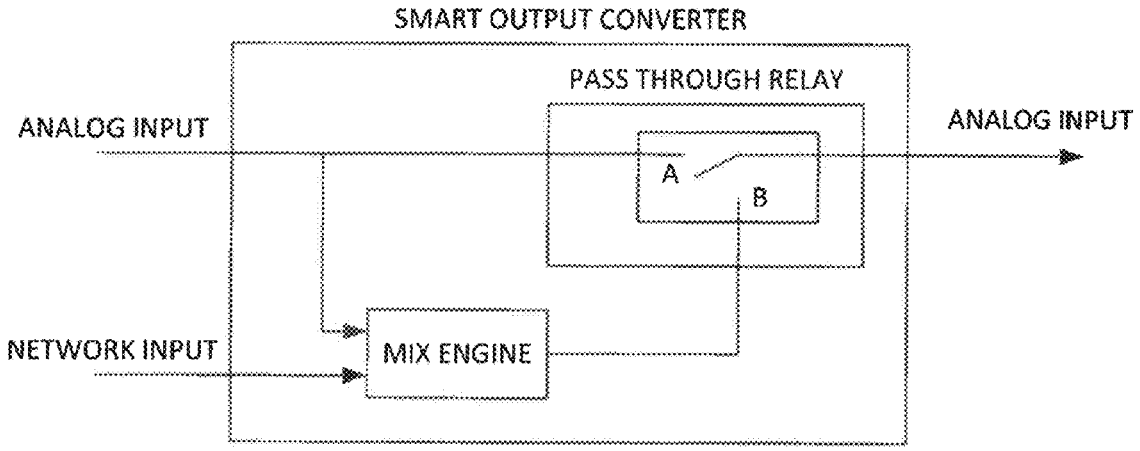
FIG. 9 illustrates a smart output converter.

Referring to FIG. 9, an exemplary operation of the smart output converter is illustrated. When the smart output converter is not powered, the pass through relay is latched in the A position, so the legacy analog signal passes straight through. When powered up the relay switches to the B position, and the mix engine combines both network input and the analog input, with a unity gain for the analog input.

The smart output converter of FIG. 9 implements all of the smart functionality previously enumerated for smart output devices in general, and smart speakers in particular. Other instantiations of audio output converters can also be constructed that accommodate other types of audio connectors and audio signals including, for example, a converter that delivers audio intended for headphone monitoring through a standard headphone jack. It is desirable to maintain a one-to-one relationship between a sound reproduction device (or recording device) and its associated converter. Doing so minimizes the potential to introduce configuration errors into the sound reinforcement system.

With respect to a system control software development kit, as previously noted, the system control protocol facilitates multiple instances of a control application to be used to operate the system. To make it easier to implement such control applications the system control software development kit (SDK) may also be used. The SDK encapsulates the protocol details and provides a programmatic interface for control applications to use. The SDK is preferably implemented as a software module that executes on the same platform that the control application is implemented on.

The availability of the system control SDK simplifies the implementation of different versions of a system control application. For example, a control application to be used by performers in controlling their own monitor mix would not provide access to control other mixes, including the house mix. It could also be optimized for use on the smaller sized screen of a mobile phone. A different version of the control application could be made available for non-technical persons who are renting a venue to be able to easily adjust the house mix without allowing overall volume levels to be too high and without exposing all of the detailed control capabilities that a professional sound engineer might utilize.

The system control SDK can also operate in a device emulation mode so that a sound engineer can pre-configure a show without needing to be connected to any of the actual devices. Using this capability the engineer can instantiate all of the various endpoint devices that will be needed, name the devices, and establish a set of initial operating parameters. This information can then be saved to a file and recalled when the actual system is being configured at the venue. Device emulation mode also provides a very convenient and safe way for new operators to become familiar with the various functions and capabilities of the sound system control application.

An exemplary type of system is a sound reinforcement system for live performance where audio streams from one or more sources (e.g. microphones, musical instruments and devices containing pre-recorded audio) are combined and aesthetically enhanced in various ways before being sent to one or more speakers, where the several speakers serve different needs, as well as to one or more recording devices. A paging system serving the needs of one or multiple buildings where audible messages from one or several sources must be able to be dynamically routed to specific areas of a building or a collection of buildings (a campus), or to every location within the building or campus. Such a system supports coordination of message delivery such that messages from the various sources do not collide with one another, and so that emergency and life-safety messages are always delivered regardless of what other messages are currently being distributed. A consumer entertainment system where several sources of video entertainment (e.g. cable TV channels, digital video recorder, Blu-ray disc, video programming streamed via the Internet) and several sources of audio entertainment (e.g. broadcast radio, audio CD, audio media files and audio programming received via the Internet or via a personal mobile device) are simultaneously available for consumption using one or more video displays and speaker systems which may be located in one or more rooms throughout the consumer's home. A broadcast production facility where sources of audio and video (e.g. microphones, cameras and media playback devices) must be routed to a variety of different media processing stations, and the resulting processed media then sent on to a variety of destinations including monitoring equipment, recording devices and transmission head ends.

Figure 12:
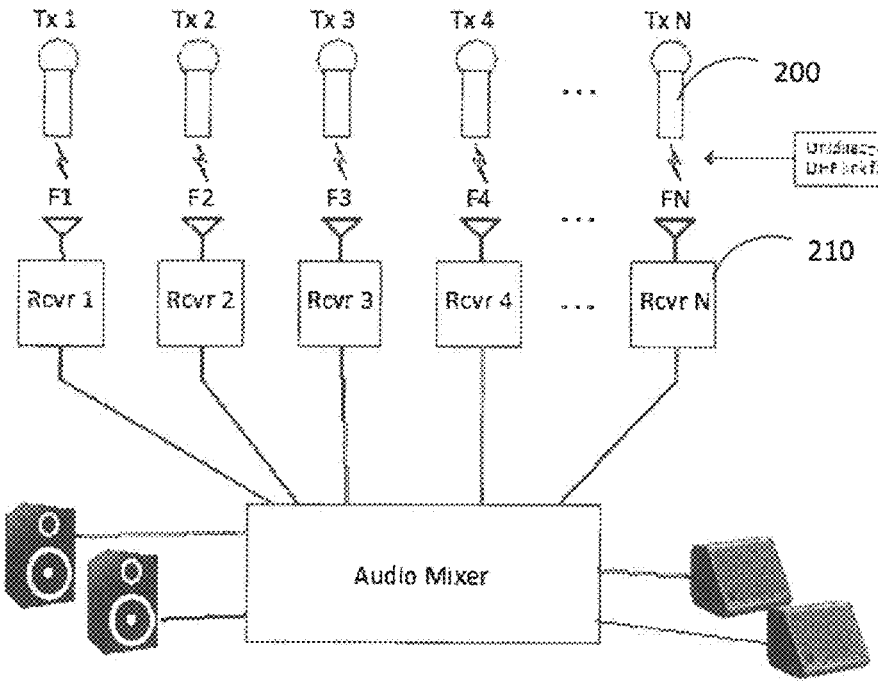
FIG. 12 illustrates a multi-channel wireless microphone system.

Referring to FIG. 12, wireless microphone systems are generally partitioned into a transmitter portion 200 and a receiver portion 210. The transmitter portion 200 is usually implemented either as a handheld vocal microphone that incorporates a transmitter device, or as a body pack transmitter to which various body-mounted microphones can be connected. The primary function of the transmitter portion is to convert sounds received via a microphone element into a wireless transmission suitable for reception on a corresponding receiving device 210.

The receiver portion 210 is usually a small box with one or more antennas, various controls, and a front panel display. Its primary function is to receive the wireless transmission and typically convert it to a line-level audio output compatible with the rest of the sound reinforcement system. The controls and display facilitate configuration of the receiver portion 210.

In many instances it is necessary to deploy multiple independent channels of wireless microphone systems simultaneously. Successful deployment of any wireless microphone system, but especially a multi-channel wireless microphone system, can be technically challenging. Some of the primary issues may include:

(1) Selecting a suitable place to physically locate the one or more wireless receivers so that they have good RF reception and are able to be cabled into the rest of the sound system.

(2) Determining which RF frequencies are available for transmitters and receivers to use in a given RF environment.

(3) Selecting, from among those frequencies determined to be available, a particular set of frequencies for transmitters and receivers to use, taking care to avoid certain spacing intervals known to cause intermodulation interference.

(4) Selecting a transmitter power level that is sufficient to enable clear reception but not too strong in order to reduce intermodulation interference.

(5) Causing a given receiver and transmitter to both operate on an assigned frequency, at which point the transmitter and receiver are considered to be "paired".

(6) Keeping track of which wireless transmitter is paired to a given receiver and then connecting the appropriate audio cable to each receiver's audio output port so that audio signal routing can be correctly performed.

(7) Adjusting assigned frequencies as needed (in both the transmitter and receiver) to accommodate changing conditions in the radio frequency environment, including the emergence of interferers.

Figure 13:
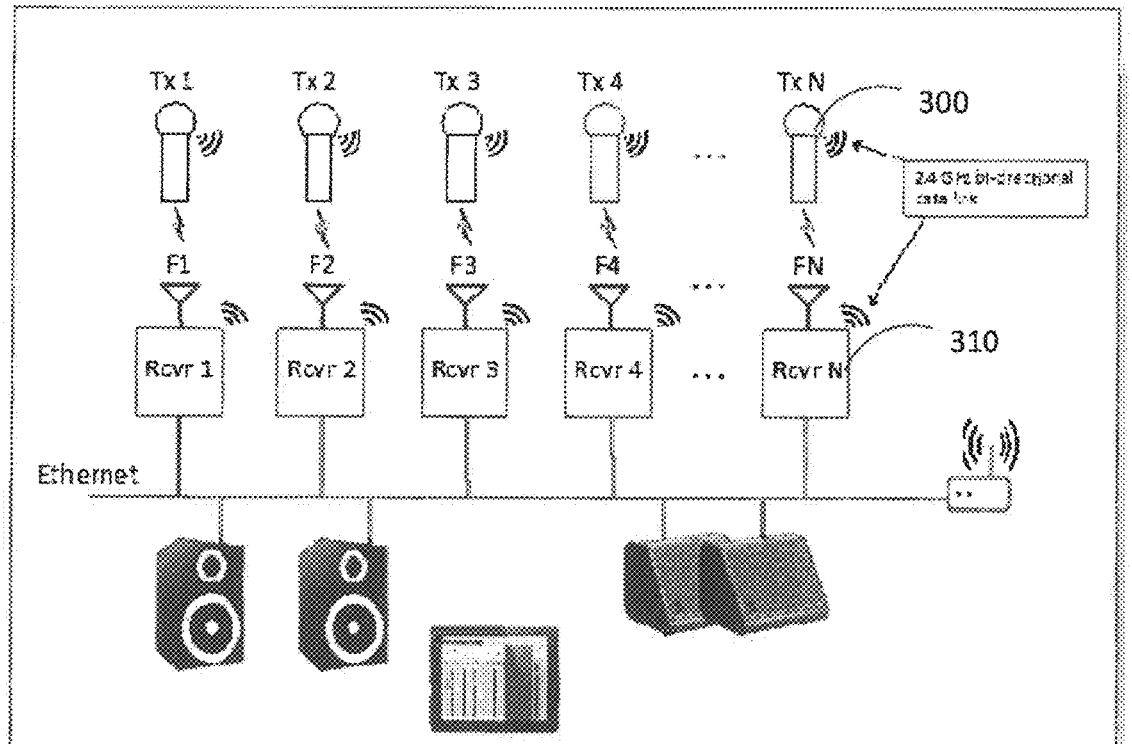
FIG. 13 illustrates a multi-channel wireless microphone system.

(8) Monitoring the battery status of the transmitter so that battery exhaustion does not occur during a performance Referring to FIG. 13, a modified wireless microphone system may incorporate features which, taken together or individually, address such complexity points, and provide an improved system.

Figure 14:
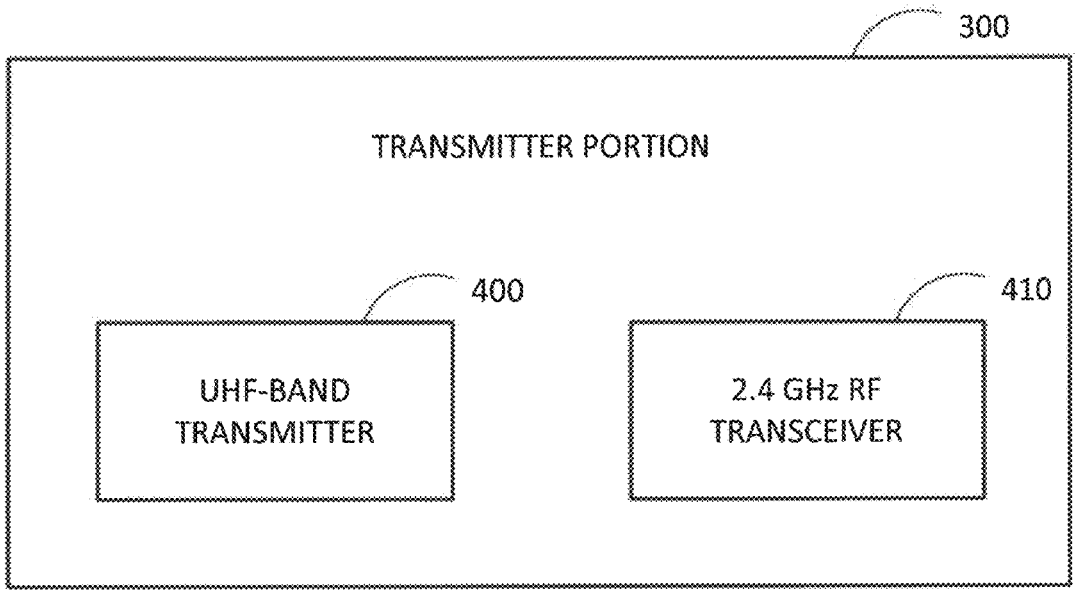
FIG. 14 illustrates a transmitter portion.

Referring to FIG. 14, in addition to a UHF-band transmitter for sending the audio signal, each wireless microphone transmitter portion 300 also preferably incorporates a low-power RF transceiver 410 operating in the 2.4 GHz unlicensed band for data. This RF transceiver 410 operates bi-directionally, and supports both unicast and broadcast modalities. By using this data link the RF transceiver 410 can send and/or receive control and status information even when it is not paired with a specific receiver. This 2.4 GHz link is preferably not used to transmit the microphone's audio signal to the receiver.

The 2.4 GHz RF transmitter 410 facilitates parameters to be stored in and directly retrieved from each transmitter portion 300. Such parameters may include, for example, assigned name (e.g. Mary's Wireless Mic), gain and equalization settings, effect send levels, and/or scene data. Since each such dataset is uniquely identified to the corresponding transmitter portion, it does not matter which receiver unit it is paired with, and receiver units can properly be considered, with respect to such data, as just an infrastructure component similar to how a WiFi access point is regarded.

For example, even though a WiFi network may have multiple access points, users today need not be concerned about which particular access point their mobile device is currently connected to. The combination of binding parameters to wireless microphone transmitter portions, and treating receivers as infrastructure, enables system operators to control wireless microphones in the same manner and with the same set of capabilities that are available for wired microphones with internal controls, as previously described herein.

Figure 15:
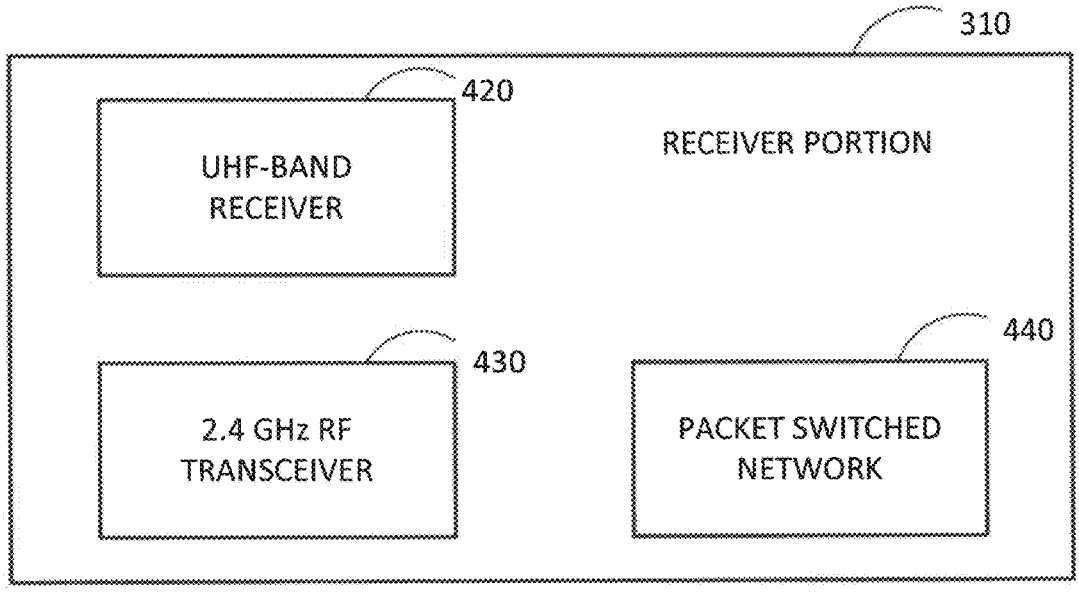
FIG. 15 illustrates a receiver portion.

Referring to FIG. 15, in the wireless microphone system, each of the receiver portions 310, include a UHF band receiver 420 and a 2.4 GHz RF receiver 430, and are connected to a packet switched network (such as Ethernet) 440 so that the receiver units can work together, such as in a peer-to-peer manner, to collectively implement system configuration and operational functions as described herein. The packed switched network 440 may also carry the audio from each transmitter-receiver pair, making each audio stream directly available to where it will be consumed.

With the separation of the audio and the data wireless transmissions, the wireless microphone system may significantly reduce the complexity and minimizes the opportunity for configuration errors when setting up and operating single or multi-channel wireless microphone systems.

Often receivers generally include front panel mounted controls, indicators, and displays so that an operator may adjust the receiver controls. In addition, receivers need a power cable to power the electronics therein, an audio cable to send the audio to another device, and an antenna connection to receive the signal from the transmitter. Taken together these constraints require the receiver to be placed in a location that is readily accessible to a technician for configuration and operation, and in a location convenient to the various types of cabling that must be routed to it. However, the receiver and its associated antennas also need to be located where a sufficiently strong RF signal can be received, and often these requirements are at odds with one another. For example, placing the receiver up high may be best for RF reception, but makes it difficult or impossible for a technician to access the receiver.

Figure 16:
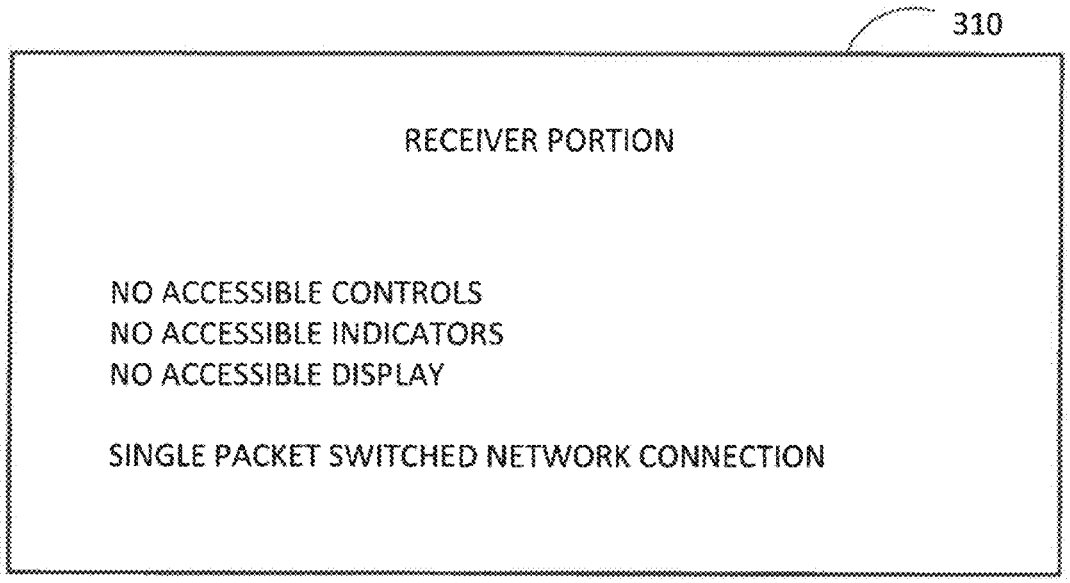
FIG. 16 illustrates accessible controls, indicators, and display of the receiver portion.

Referring to FIG. 16, the wireless receiver portion 310 preferably has no accessible controls on the external thereof, no accessible indicators on the external thereof, and/or no accessible display on the external thereof. Furthermore, the wireless receiver portion when interconnected to the antenna, is preferably provided with only a single packet switched network connection, such as an Ethernet connection for an Ethernet cable. The single packet switched network connection, in addition to transporting audio, sending parameters, and receiving parameters such as status information, may also be used to receive power such as power over Ethernet. The removal of the controls, indicators, and/or display together with a single network connection makes it more feasible to physically locate the receiver portion wherever optimal RF reception may be obtained.

Techniques for determining which RF frequencies are available for use in the local RF environment tend to vary. By way of example, products may allow the user to initiate a scan function that steps through each available frequency and identify those that appear to be quiet, and thus useable. This process can be lengthy, and must be repeated on each individual receiver unit. It is usually only performed at system setup time, and thus does not track changes in the RF environment. By way of example, products may allow frequency scanning and mapping to be performed with the aid of external equipment such as a personal computer, but this requires special cabling to be in place and special software to be installed on the personal computer.

Figure 17:
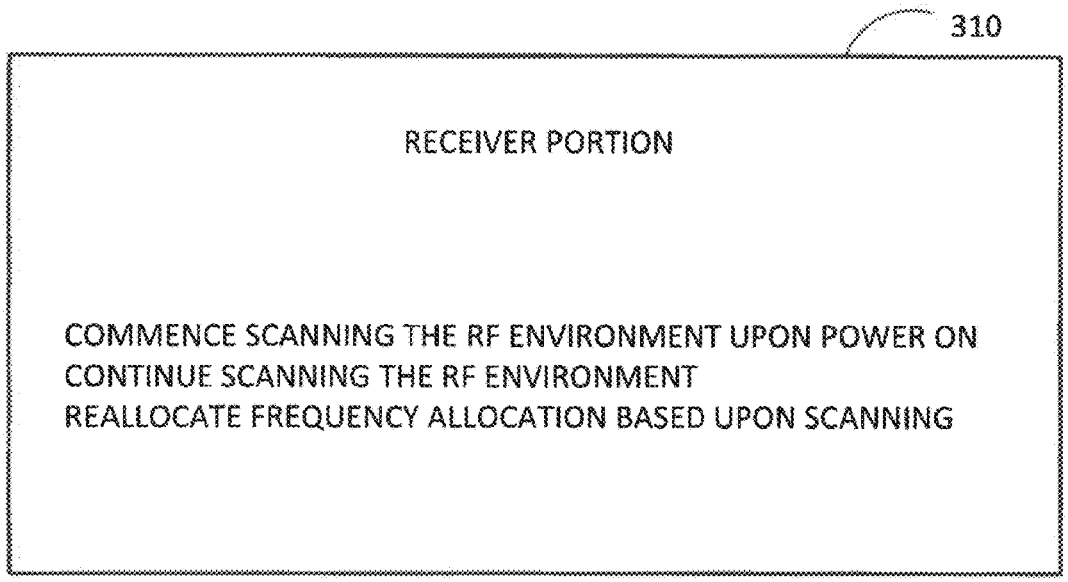
FIG. 17 illustrates scanning and frequency allocation of the receiver portion.

Referring to FIG. 17, each receiver portion 310 preferably commences scanning the RF environment automatically as a result of being powered on, based upon a request being made from a transmitter portion, and/or a request being made from a networked computing device. The receiver portion 310 preferably continuously and/or periodically automatically commences scanning while not being paired with a microphone transmitter portion. The receiver portion 310 preferably also automatically commences scanning while not otherwise performing other tasks or otherwise sufficient computing resources are available for such scanning so as to not interfere with its ability to receive and process received audio and/or other data. The receiver portion 310 may automatically commence scanning when the quality of the audio data being received is sufficiently low and/or otherwise sufficiently drops in its quality. The results from scanning by one or more of the receiver portions may be used to determine an updated view of the RF environment. This updated view of the RF environment may be used by the receivers and/or a computing device interconnected therewith to reallocate the frequencies used by one or more of the receiver portions and/or transmitter portions. Preferably, multiple receivers scan the RF environment, each typically from a different spatial location within the RF environment. In this manner, each of the receivers will normally determine different characteristics of RF environment, particular to their particular location within the RF environment. The results from scanning from the multiple different receivers are preferably combined together to determine a more comprehensive view of the RF environment. The combined comprehensive view of the RF environment may be used for subsequent use by the microphone system, such as frequency allocation.

Particular attention needs to be used in selecting frequencies used by the pairs of transmitters and receivers in order to avoid interferers and to avoid creating additional, so-called intermodulation interference, that arises when multiple transmitters operate simultaneously at certain frequency intervals and power levels. Existing products facilitate frequency selection by suggesting frequencies that are at appropriate intervals, but these suggestions are not adjusted with respect to known interferers. It is up to the operator to utilize scan results in determining which specific frequencies will be utilized. Frequency allocation typically happens at system setup time and is static until such time as the operator changes it. Moreover, the frequency allocation is prone to errors.

Referring to FIG. 18, the system preferably does not allocate the transmission frequencies to be used by a transmitter portion and/or a receiver portion until after the transmitter portion is powered on and is ready to be used by the system. When a transmitter portion is powered on, one or more of the components of the system preferably automatically selects and allocates an appropriate frequency based upon information discovered about the local RF environment with heuristics to avoid intervals known to create intermodulation distortion. This allocated frequency is then used by the selected transmitter portion and the corresponding receiver portion for subsequent communications. In the event that the wireless microphone is later switched off, the assigned frequency is freed up and made available for subsequent re-use by the same wireless microphone and/or other wireless microphones. Further, the system may upon the occurrence of other events and/or time intervals and/or signal quality issues and/or continuously, determine whether the existing allocation of frequencies should be reallocated for one or more transmitter portions and/or receiver portions and automatically allocating accordingly.

It is not desirable to manually set the UHF transmission power levels based on the operator's best judgment because it is very subjective and prone to substantial resulting errors. Referring to FIG. 19, the system preferably automatically determines and sets appropriate UHF transmission power levels based upon a received signal strength at multiple receivers. Transmission power levels may be dynamically adjusted in a manner determined to increase transmitter battery life and reduce intermodulation interference while maintaining clear reception of the audio signal.

Once a set of usable frequencies have been determined, each receiver portion is, in turn, tuned to one of the available frequencies. Also, each corresponding transmitter portion is, in turn, tuned to a corresponding one of the available frequencies as its receiver portion. The transmitter portion and the receiver portion are paired together.

Transmitter tuning is usually done by using infrared signaling. The transmitter (typically a microphone or body pack) is held close to the receiver, a control on the receiver is used to activate an infrared beam and an infrared receptor within the transmitter picks up this signal and extracts the desired frequency value. In most instances, this infrared signaling is the only manner that control information can be sent to the transmitter, and this can only happen when the transmitter and receiver are in close proximity and when an operator initiates the process. Once a transmitter is paired to a given receiver, the sound system operator then sets up the appropriate audio signal cabling and routing, which is prone to error. If the pairing relationship is changed for any reason, the audio signal routing would also need to be changed, which is prone to error.

Referring to FIG. 20, the system preferably automatically allocates usable frequencies and pairs each transmitter portion to the best available receiver portion, as determined by measured signal strength. Receiver portions are tuned via commands sent over the Ethernet network. Transmitter portions are tuned and transmission power levels are set via commands sent over the 2.4 GHz data link. In this manner, there is no need for a technician to physically access either the transmitter portions or the receiver portions.

Signal routing preferably occurs automatically because each receiver portion uses its network connection to make its received audio stream directly available to all network-connected devices. Each such audio stream is uniquely labeled with the identifier of the wireless microphone from which it originates. So even if pairing relationships are later changed, no adjustments to signal routing are required. To provide positive visual identification, an operator may cause a small indicator to flash on a given receiver and on any transmitter that is currently paired to it.

When changes in the RF environment make it desirable to adjust frequency, transmitter power, and/or pairing relationship, these changes are traditionally first made to the receiver (using the controls on the receiver's front panel) and then on the transmitter (using the IR signaling technique described previously). Further, if pairing relationships are changed, the audio signal cabling and or channel mapping traditionally must also be modified. Also, when signal routing changes, it is often necessary for an operator to apply the previous channel's parameters (e.g. gain and equalization) to the new channel.

Referring to FIG. 21, the wireless microphone system preferably permits the operator to change any of frequency, transmission power, and/or pairing, directly from the system control display, without ever needing to physically access either the receiver or the transmitter, and without needing to make any changes to physical audio signal routing cabling. Operating parameters (e.g. assigned name, gain, equalization, etc.) remain intrinsically bound to the wireless microphone and are unaffected by such changes.

Traditionally transmitter battery level, received signal strength and other operating parameters are only available on the receiver's front panel display. Since it is frequently the case that receivers are not located physically adjacent to where the sound system operator is positioned, a technician must go to the place where each receiver is located and look at each receiver's front panel display.

Referring to FIG. 22, the receiver portion(s) of the wireless microphone system makes comprehensive status information continuously available to all system control displays. In particular, a battery indicator is preferably included on each fader strip that is associated with a wireless microphone. The other wireless parameters are directly viewable by opening the wireless microphone's detail page on a computing device interconnected to the network.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

I claim:

1. An audio system comprising:

(a) a transmitter system that includes a microphone for receiving an analog audio source and a transmitter module wirelessly transmitting a transmission signal representative of said analog audio source;

(b) said transmitter module transmitting said transmission signal in a UHF-band;

(c) said transmitter module supporting both unicast and broadcast modalities transmitting and receiving digital data in a 2.4 GHz band, where said digital data is at least one of control data for controlling said audio system and status data for the status of said audio system;

(d) said transmitter module configured to not being capable of sending said transmission signal representative of said analog audio source using said 2.4 GHz band;

(e) a receiver system remote from said transmitter module that includes a receiver module for wirelessly receiving said transmission signal representative of said analog audio source and converting a received said transmission signal representative of said analog audio source to a line-level audio output;

(f) said receiver system incorporating a module supporting both unicast and broadcast modalities transmitting and receiving digital data in a 2.4 GHz band, where said digital data is at least one of control data for controlling said audio system and status data for the status of said audio system.

2. The audio system of claim 1 wherein said microphone is hand-held.

3. The audio system of claim 1 wherein said transmitter module includes a body pack and said microphone.

4. The audio system of claim 1 wherein said digital data includes parameters of said transmitter system.

5. The audio system of claim 4 wherein said parameters includes at least one of (a) an assigned name, (b) a gain setting, (c) an equalization setting, (d) an effect send level, and (e) a scene data.

6. The audio system of claim 5 wherein said parameters are uniquely identified with said transmitter system by said receiver system based upon said parameters.

7. The audio system of claim 1 wherein said receiver system include a communication module that is capable of sending and receiving communication data over a wired packet switched network to send and receive communication data with another receiver system separate from said UHF-band and said 2.4 GHz band.

8. The audio system of claim 7 wherein said receiver system transmits said transmission signal representative of said analog audio source to said another receiver system, said another receiver system converting said transmission signal representative of said to analog audio source to another line-level audio output.

9. The audio system of claim 7 wherein said communication module includes no more than one connection for said packed switched network.

10. The audio system of claim 7 further comprising said another receiver system remote from said transmitter module that includes another receiver module for wirelessly another receiving another transmission signal representative of another analog audio source and converting said another received said another transmission signal representative of said another analog audio source to another line-level audio output.

11. The audio system of claim 10 wherein said another receiver system include another communication module that is capable of sending and receiving communication data over said packet switched network to send and receive communication data with said receiver system.

12. The audio system of claim 11 wherein said receiver system and said another receiver system are arranged in a peer to peer manner.

13. The audio system of claim 1 wherein said receiver system includes no accessible controls on the external thereof.

14. The audio system of claim 1 wherein said receiver system includes no accessible indicators on the external thereof.

15. The audio system of claim 1 wherein said receiver system includes no accessible display on the external thereof.

16. The audio system of claim 1 wherein said receiver system includes no accessible controls on the external thereof, said receiver system includes no accessible indicators on the external thereof; said receiver system includes no accessible display on the external thereof, and said communication module includes no more than one connection for a packed switched network.

17. The audio system of claim 1 wherein said receiver system scans a radio-frequency environment upon being powered upon.

18. The audio system of claim 1 wherein said receiver system scans a radio-frequency environment upon a request being made from a transmitter system.

19. The audio system of claim 1 wherein said receiver system scans a radio-frequency environment upon a request being made from a networked based computing device.

20. The audio system of claim 1 wherein said receiver system periodically scans a radio-frequency environment while not being paired with a corresponding transmitter system.

21. The audio system of claim 1 wherein said receiver system periodically scans a radio-frequency environment when it is determined sufficient computational resources are available so as to not interfere with the receiver system being capable of receiving and processing other data.

22. The audio system of claim 1 wherein said receiver system scans a radio-frequency environment based upon a quality of said transmission signal representative of said analog audio source.

23. The audio system of claim 1 wherein said receiver system scans a radio-frequency environment based upon a change in quality of said transmission signal representative of said analog audio source.

24. The audio system of claim 1 wherein said receiver system based upon a scan of a radio-frequency environment modifies a frequency to receive said transmission signal.

25. The audio system of claim 1 wherein said transmitter system based upon a scan of a radio-frequency environment modifies a frequency to transmit said transmission signal.

26. The audio system of claim 1 wherein said transmitter system modifies a frequency for transmission of said transmission signal based upon said audio system scanning a local radio frequency environment.

27. The audio system of claim 1 wherein said receiver system modifies a frequency for receiving of said transmission signal based upon said audio system scanning a local radio frequency environment.

28. The audio system of claim 1 wherein said transmitter system modifies a power level used for transmitting said transmission signal in a UHF-band based upon received signal strength at said receiver system.

29. The audio system of claim 1 wherein said transmitter system modifies said power level used for transmitting said transmission signal in a UHF-band based upon received signal strength at multiple ones of said receiver system.

30. The audio system of claim 1 wherein said transmission signal is uniquely labeled with an identifier that identifies said microphone.

* * * * *